US007562780B2

(12) United States Patent
Gilpatrick et al.

(10) Patent No.: US 7,562,780 B2
(45) **Date of Patent: *Jul. 21, 2009**

(54) ACCESSORY TRAY FOR A PRESSURE WASHER

(75) Inventors: Richard J. Gilpatrick, Whitewater, WI (US); Daniel D. Monty, Eagle, WI (US); James L. Welch, Waukesha, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 586 days.

This patent is subject to a terminal disclaimer.

(21) Appl. No.: 11/003,156

(22) Filed: Dec. 3, 2004

(65) Prior Publication Data

US 2006/0118498 A1 Jun. 8, 2006

(51) Int. Cl.
*A47F 7/00* (2006.01)

(52) U.S. Cl. ..... 211/70.6

(58) Field of Classification Search ..... 211/70.6, 211/85.11, 126.1, 126.16, 13.1; 280/47.131, 280/47.17, 47.19, 47.28, 63; 248/75, 77–79, 248/89–93, 210, 211, 238; 206/561, 562, 206/557, 565; D32/25, 15–17, 19, 1, 31–33; 239/146, 147, 149; D8/61, 67, 69, 71, 373, D8/380, 381; D4/102; 15/97.1, 98, 22.1, 15/320; D34/24–26, 12, 14, 17; D6/553, D6/574, 552, 567

See application file for complete search history.

(56) References Cited

U.S. PATENT DOCUMENTS

| | | | | | |
|---|---|---|---|---|---|
| 1,981,674 | A | | 11/1934 | Solomon | |
| 2,434,140 | A | * | 1/1948 | Bernstein | 248/89 |
| D179,714 | S | | 2/1957 | Wise | |
| D206,426 | S | | 12/1966 | Wise | |
| 3,940,065 | A | | 2/1976 | Ware et al. | |
| 4,350,366 | A | * | 9/1982 | Helms | 280/655 |
| D300,406 | S | | 3/1989 | Bordian | |
| 4,874,147 | A | * | 10/1989 | Ory et al. | 248/210 |
| 4,880,248 | A | * | 11/1989 | Elmer | 280/47.35 |
| 4,899,970 | A | * | 2/1990 | Berzina | 248/210 |
| 5,299,767 | A | | 4/1994 | Simpson | |
| 5,419,497 | A | | 5/1995 | Warrington | |
| 5,452,830 | A | | 9/1995 | Hopkins et al. | |
| 5,687,856 | A | | 11/1997 | Kendrena | |
| D396,924 | S | * | 8/1998 | Cardenas | D34/24 |
| 5,810,213 | A | | 9/1998 | Flores et al. | |
| 5,865,409 | A | * | 2/1999 | Nimer | 248/210 |
| 5,957,352 | A | | 9/1999 | Gares | |
| 5,967,426 | A | | 10/1999 | McLeod | |
| 6,000,497 | A | * | 12/1999 | Kain et al. | 182/129 |

(Continued)

*Primary Examiner*—Jennifer E. Novosad
(74) *Attorney, Agent, or Firm*—Michael Best & Friedrich LLP

(57) ABSTRACT

An accessory tray for a pressure washer. The accessory tray of some embodiments has an accessory supporting portion for supporting and/or storing accessories of the pressure washer. The accessory supporting portion has a concave surface, which allows the accessories to be supported substantially normal to the ground regardless of the relative angle between the accessory tray and the ground. Some embodiments also have a flexible cantilevered member positioned above a portion of the accessory tray to trap an accessory against the accessory tray. Some embodiments can have a hose hook that supports and stores a hose of the pressure washer. The hose hook has a concave shape to allow the hose to be supported substantially normal to the ground.

9 Claims, 7 Drawing Sheets

U.S. PATENT DOCUMENTS 6,070,808 A 6/2000 Kildow
6,089,351 A * 7/2000 Ahl et al. ..... 182/129
6,279,838 B1 8/2001 Sivells et al.
D463,888 S 10/2002 Rehkugler et al.
6,497,423 B1 * 12/2002 Perelli et al. ..... 280/47.34
D468,591 S 1/2003 Lillelund et al.
6,536,557 B2 * 3/2003 Gibson et al. ..... 182/161
6,695,235 B2 2/2004 Faller et al.
6,755,478 B2 6/2004 Messinger-Rapport
6,758,482 B2 7/2004 Stallbaumer
6,827,357 B2 * 12/2004 Calmeise et al. ..... 280/47.34
6,837,383 B1 * 1/2005 McElhaney, Jr. ..... 211/70.6
7,077,238 B2 * 7/2006 Butler et al. ..... 182/129
7,175,031 B2 * 2/2007 Matthews ..... 211/70.6
7,182,176 B2 * 2/2007 Gibson et al. ..... 182/129
D546,509 S * 7/2007 Gilpatrick et al. ..... D32/25
7,240,910 B2 * 7/2007 Stuemke ..... 280/79.5
2002/0017430 A1 * 2/2002 Rosko ..... 182/129
2002/0109318 A1 * 8/2002 Calmeise et al. ..... 280/47.35
2003/0122331 A1 * 7/2003 DiGiacomo et al. ..... 280/47.35
2004/0046044 A1 3/2004 Bennett et al.
2004/0055979 A1 * 3/2004 Fabregas ..... 211/70.6
2004/0217238 A1 * 11/2004 Chochinov et al. ..... 248/99
2005/0056486 A1 * 3/2005 Butler et al. ..... 182/129
2005/0252871 A1 * 11/2005 Le Roux ..... 211/70.6

* cited by examiner

ACCESSORY TRAY FOR A PRESSURE WASHER

BACKGROUND OF THE INVENTION

Many different accessory trays currently exist for holding accessories such as a pressure washer spray gun, a variety of nozzles for the spray gun, a spray hose, and the like. The tray generally attaches to the frame of the pressure washer near the area of a handle. Typically, this area of the frame is angled with respect to the ground to offset the handle from the remainder of the frame. The angle of the frame is not standardized, and the angle of inclination generally establishes an angle of a flat accessory-engaging surface on the accessory tray. Generally, the flat accessory-engaging surface tends to be appropriately angled such that this surface is substantially parallel to the ground, which allows the accessories to hang normal to the ground. Accordingly, most conventional accessory trays are specifically designed for a particular pressure washer due in part to the different angle of inclination of the frame.

SUMMARY OF THE INVENTION

According to the present invention, an accessory tray is provided that can be used on most pressure washers regardless of the frame's angle of inclination and yet keep the accessories normal (e.g., perpendicular or orthogonal) to the ground. The accessory-engaging area of the present invention is concave and includes apertures allowing accessories to hang generally normal to the ground regardless of the angle of the pressure washer frame relative to the ground.

Some embodiments also have a clip or semi-flexible projection that extends above a portion of the accessory engaging area of the tray. This clip can be used to retain a nozzle or other accessory within the concave area of the tray.

In some embodiments, the tray has an arcuate-shaped projection positioned on the other side of the tray relative to the concave accessory-engaging area. This projection can support the hose of pressure washer normal to the ground with the tray in any inclined position.

Further aspects of the present invention, together with the organization and operation thereof, will become apparent from the following detailed description of the invention when taken in conjunction with the accompanying drawings.

DETAILED DESCRIPTION

Figure 1:
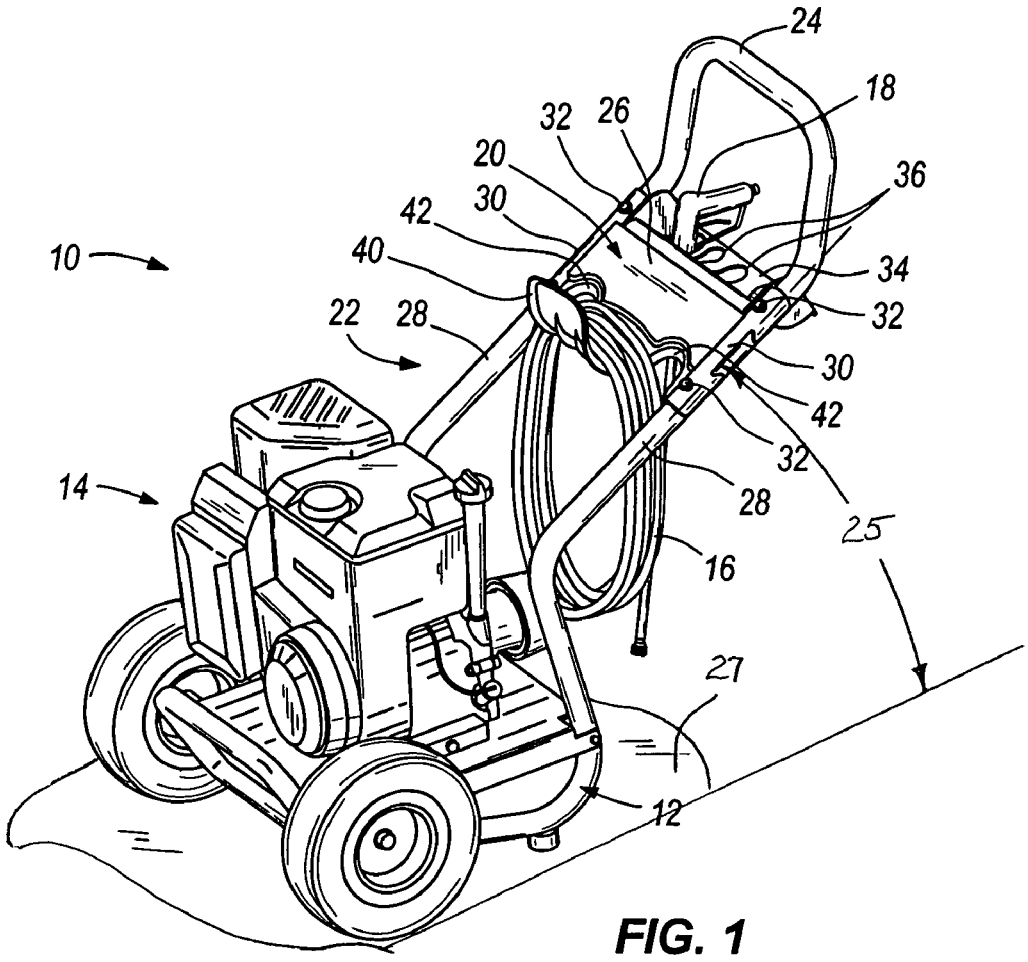
FIG. 1 is a perspective view of a pressure washer having one embodiment of an accessory tray embodying aspects of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible.

The pressure washer 10 shown in FIG. 1 includes a frame 12 and a prime mover 14 supported by the frame 12. The prime mover 14 can be an engine, electric motor, or fuel cell. The prime mover 14 generates a pressurized stream of fluid that is discharged via an accessory fluid line 16 coupled to the prime mover 14. One or more discharge control accessories 18, such as wands, spray guns, nozzles, and the like can be coupled to the fluid line 16 to control the discharge of pressurized fluid. An accessory tray 20 is coupled to the frame 12 of the pressure washer 10 to support one or more of the accessories 18 when not in use. As shown in FIG. 1, the discharge control accessories 18 and the fluid line 16 can be supported and stored on the accessory tray 20.

As previously mentioned, the accessory tray 20 is supported on the frame 12 of the pressure washer 10. As shown in FIG. 1, the accessory tray 20 is positioned on an inclined portion 22 of the frame 12. In some embodiments, this inclined portion 22 is an extension of the pressure washer frame 12 that extends toward a convenient position to be used as a handle 24 for moving the pressure washer 10. The frame 12 and/or the accessory portion defines an angle of inclination 25 relative to the ground or support surface 27. Generally, the angle of inclination of this inclined portion 22 of the frame 12 is not standardized between different models or between different manufacturers of pressure washers 10. Conventionally, this required a different accessory tray to be designed for each different angle of inclination to properly support the accessories 16, 18. However, the accessory tray 20 of the present invention is designed to be utilized on multiple different frames 12 that can have a wide variety of angles of inclination.

The accessory tray 20 has a main body portion 26 that generally extends between two inclined frame members 28 of the pressure washer frame 12. The ends 30 of the main body portion 26 are adapted to engage the frame members 28 and secure the accessory tray 20 to the pressure washer frame 12. In the illustrated embodiment, the ends 30 of the main body portion 26 have a curved configuration to match the curved configuration of the pressure washer frame 20. However, the ends 30 can be configured differently in other embodiments to engage frame members 28 having other configurations.

The ends 30 of the accessory tray 20 can be secured to the frame 12 in many different ways. For example, they can be adhesively or cohesively bonded, welded, snap fit, and the like. In the illustrated embodiment, fasteners 32 extend through apertures in the accessory tray 20 to secure the accessory tray 20 to the frame 12.

Figure 6:
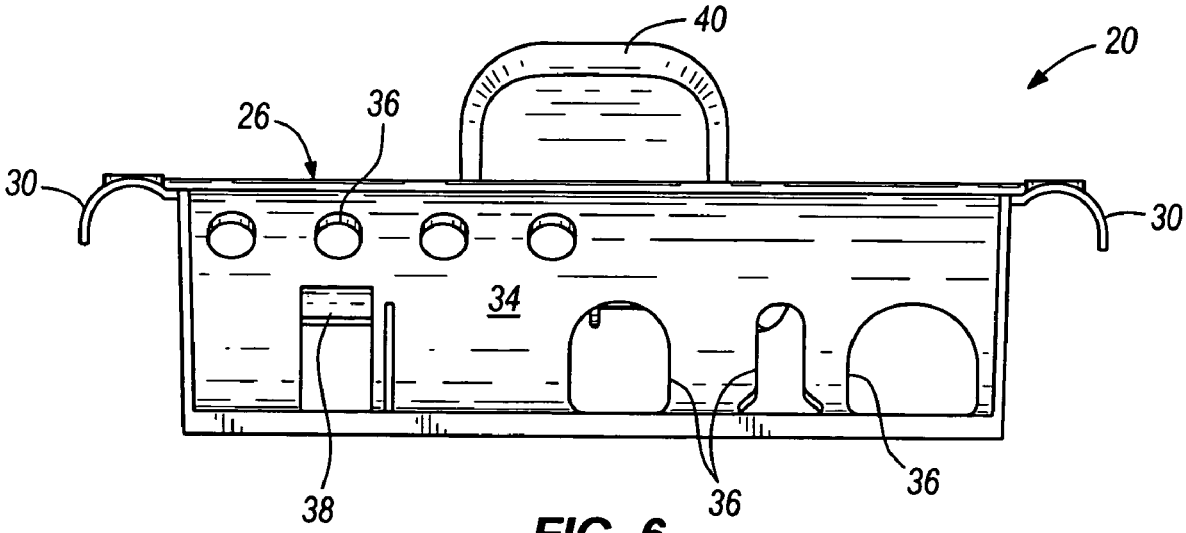
FIG. 6 is a rear view of the accessory tray shown in FIG. 1.
Figure 7:
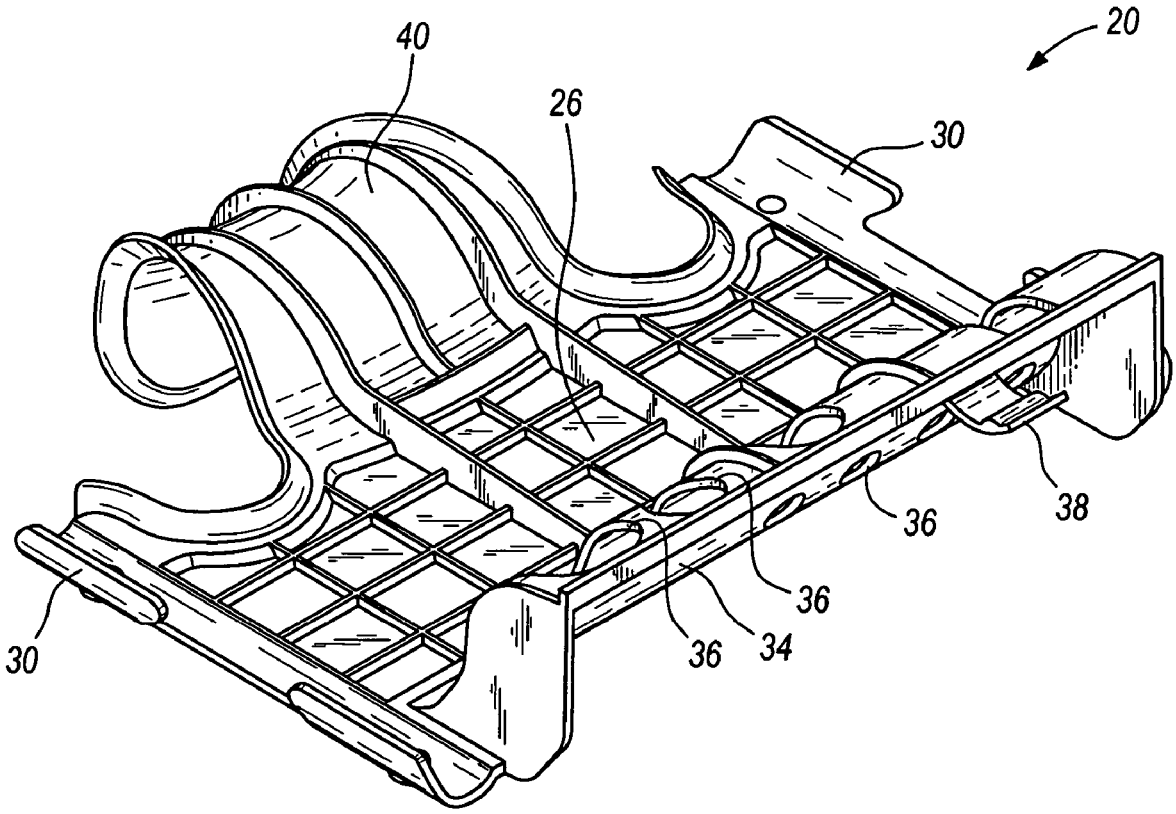
FIG. 7 is an additional perspective view of the accessory tray shown in FIG. 1.
Figure 8:
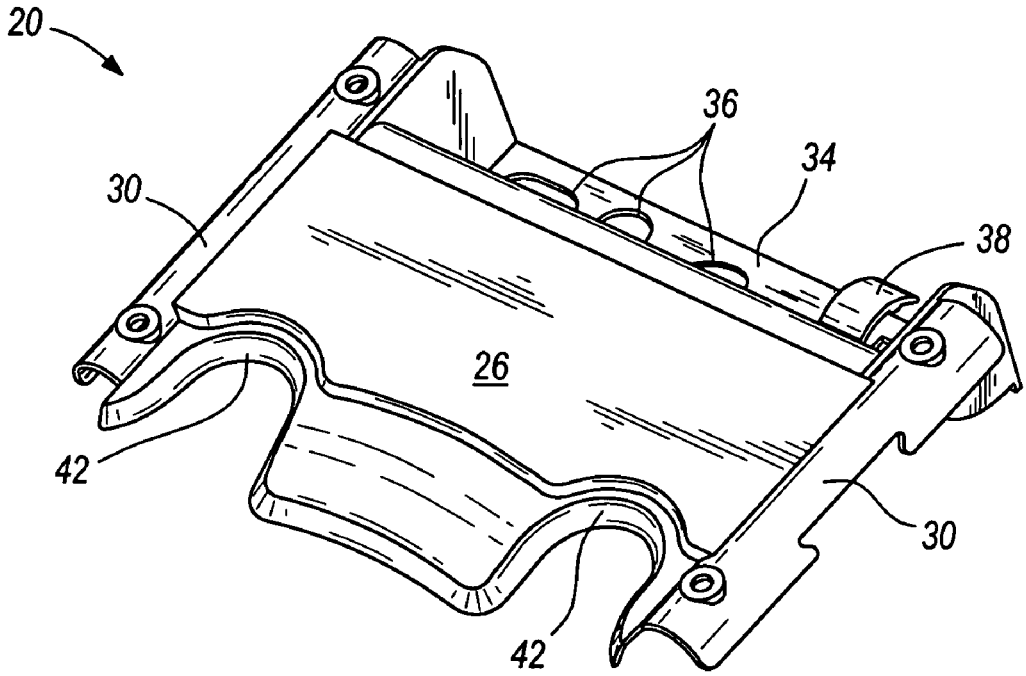
FIG. 8 is a perspective view of a second embodiment of an accessory tray embodying aspects of the invention.
Figure 9:
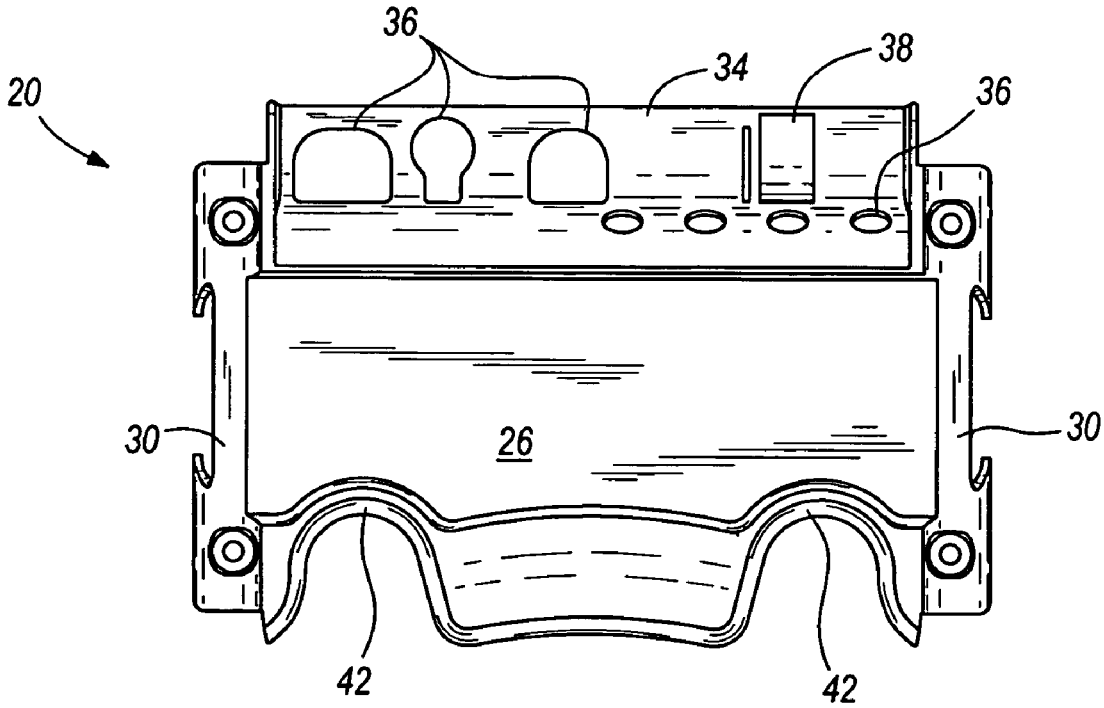
FIG. 9 is a top view of the accessory tray shown in FIG. 8.
Figure 10:
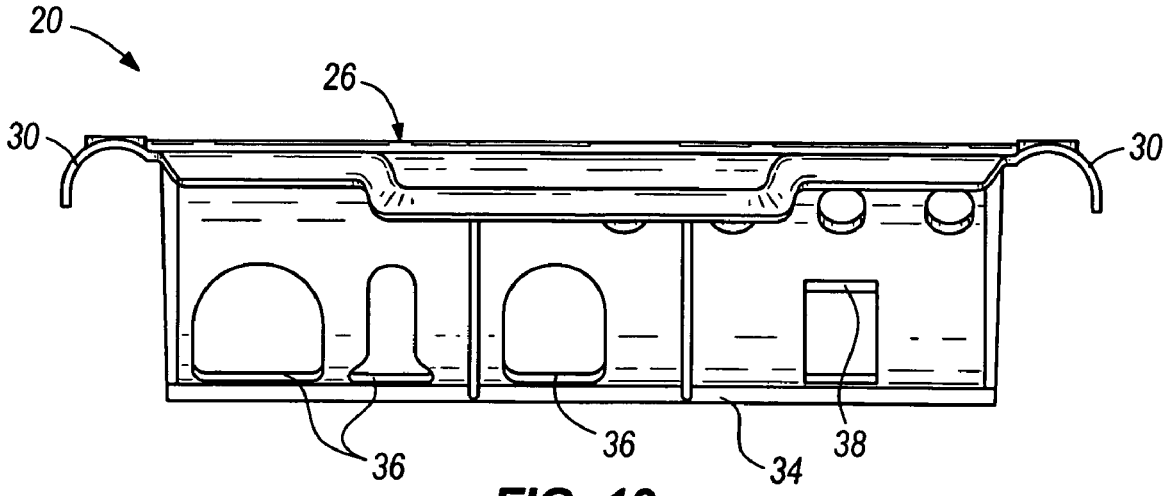
FIG. 10 is a front view of the accessory tray shown in FIG. 8.
Figure 11:
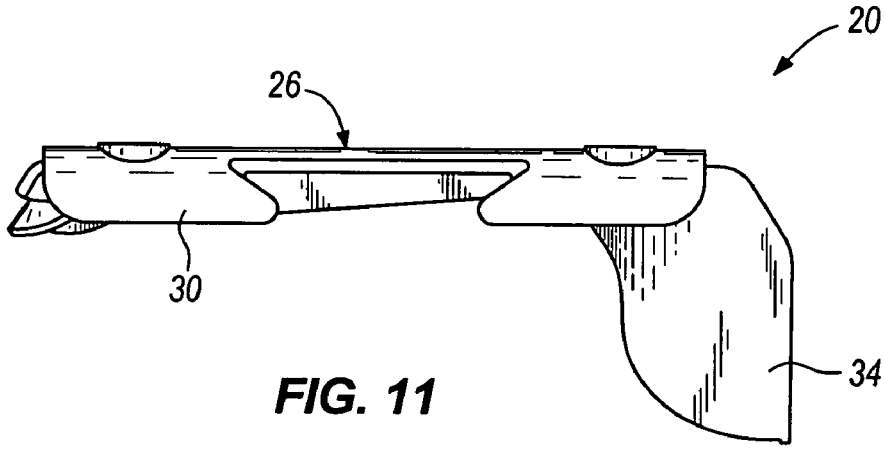
FIG. 11 is a right side view of the accessory tray shown in FIG. 8.
Figure 12:
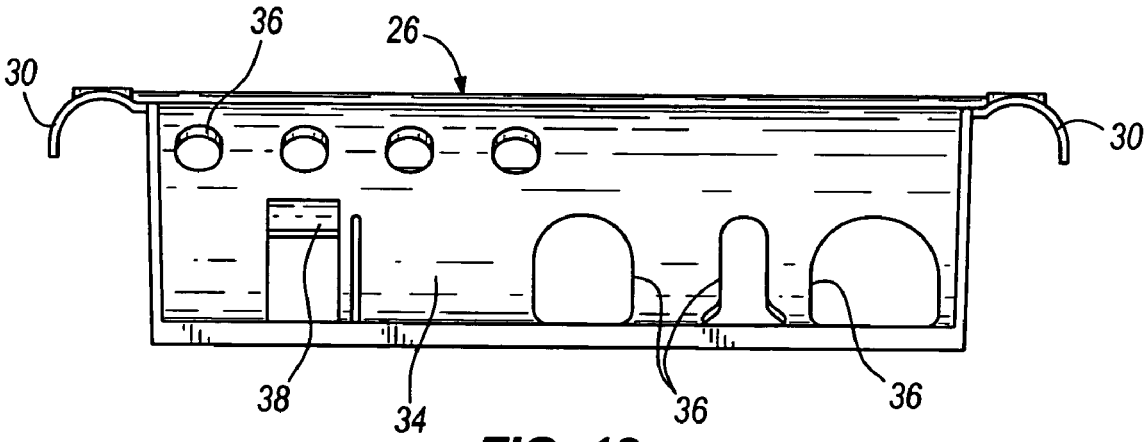
FIG. 12 is a rear view of the accessory tray shown in FIG. 8.
Figure 13:
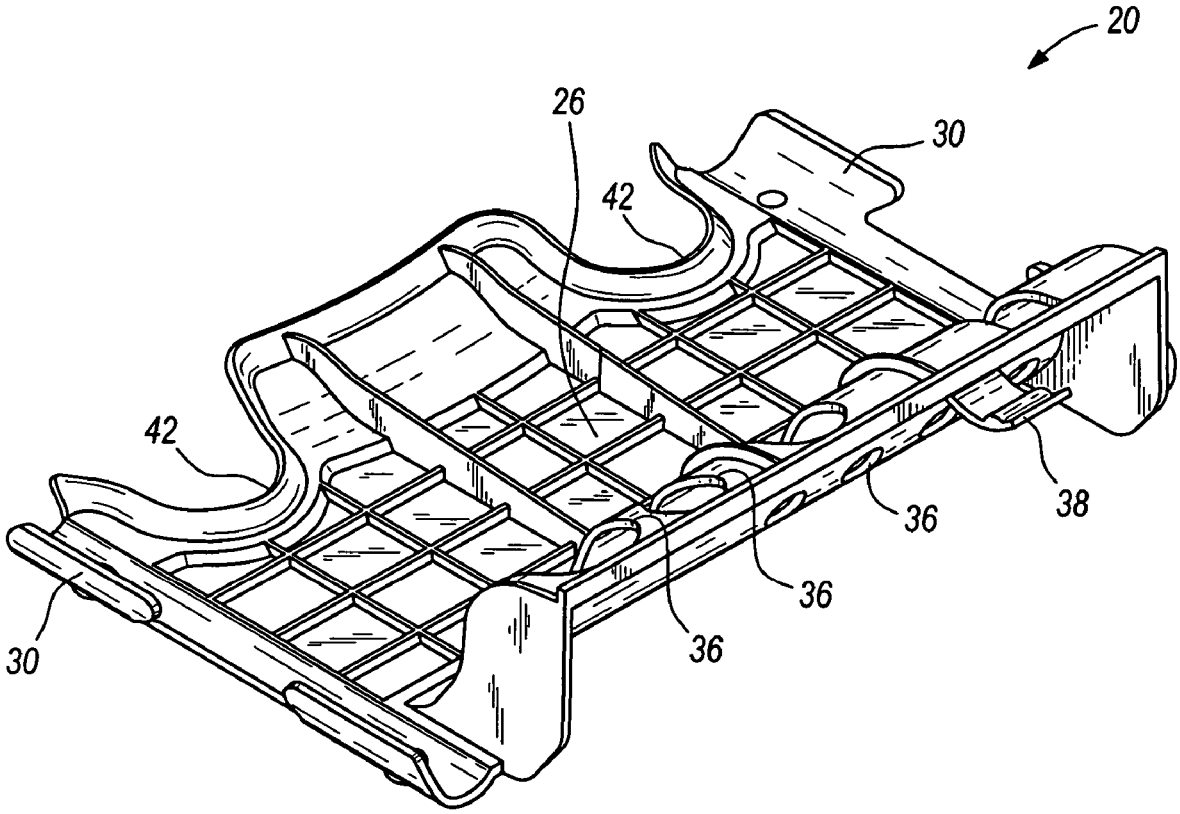
FIG. 13 is an additional perspective view of the accessory tray shown in FIG. 8.

An accessory supporting portion 34 of the accessory tray 20 is coupled to the main body portion 26. The accessory supporting portion 34 of the accessory tray 20 extends generally between the frame members 28. The accessory supporting portion 34 has a variety of accessory engaging mechanisms that can support one or more accessories. For example, as best shown in FIGS. 3, 6, and 7, several apertures 36 can extend through the accessory supporting portion 34 of the accessory tray 20 to receive and support accessories 18 in a suspended position above the ground. As illustrated, the apertures 36 can have a variety of different shapes to receive a variety of differently configured accessories 18. Furthermore, as shown in FIGS. 2 and 7, a clip or semi-flexible projection 38 can be positioned above the accessory supporting portion 34 of the accessory tray 20 to retain or trap accessories 18, such as nozzles, against the accessory supporting portion 34 of the accessory tray 20.

Figure 2:
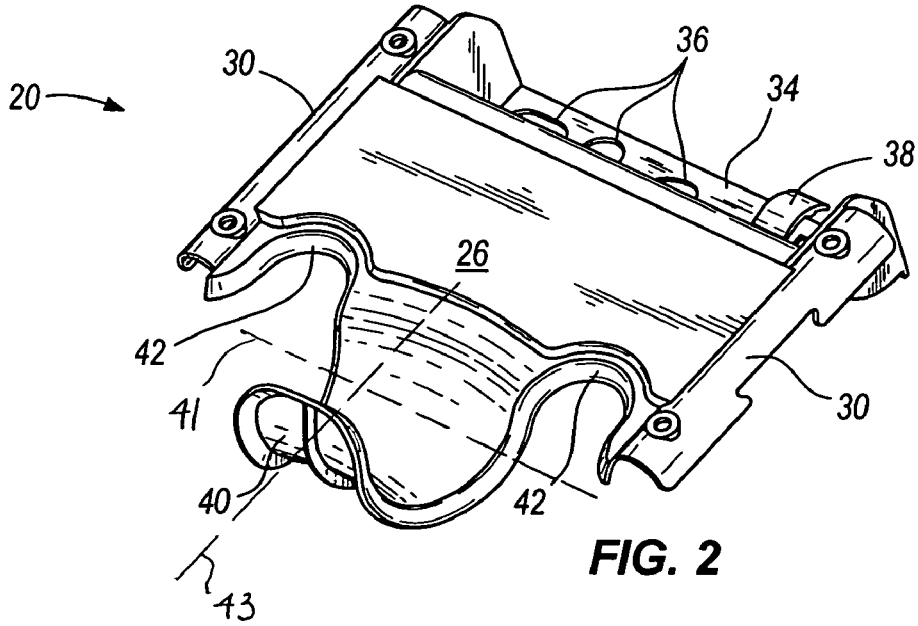
FIG. 2 is a perspective view of the accessory tray shown in FIG. 1.
Figure 3:
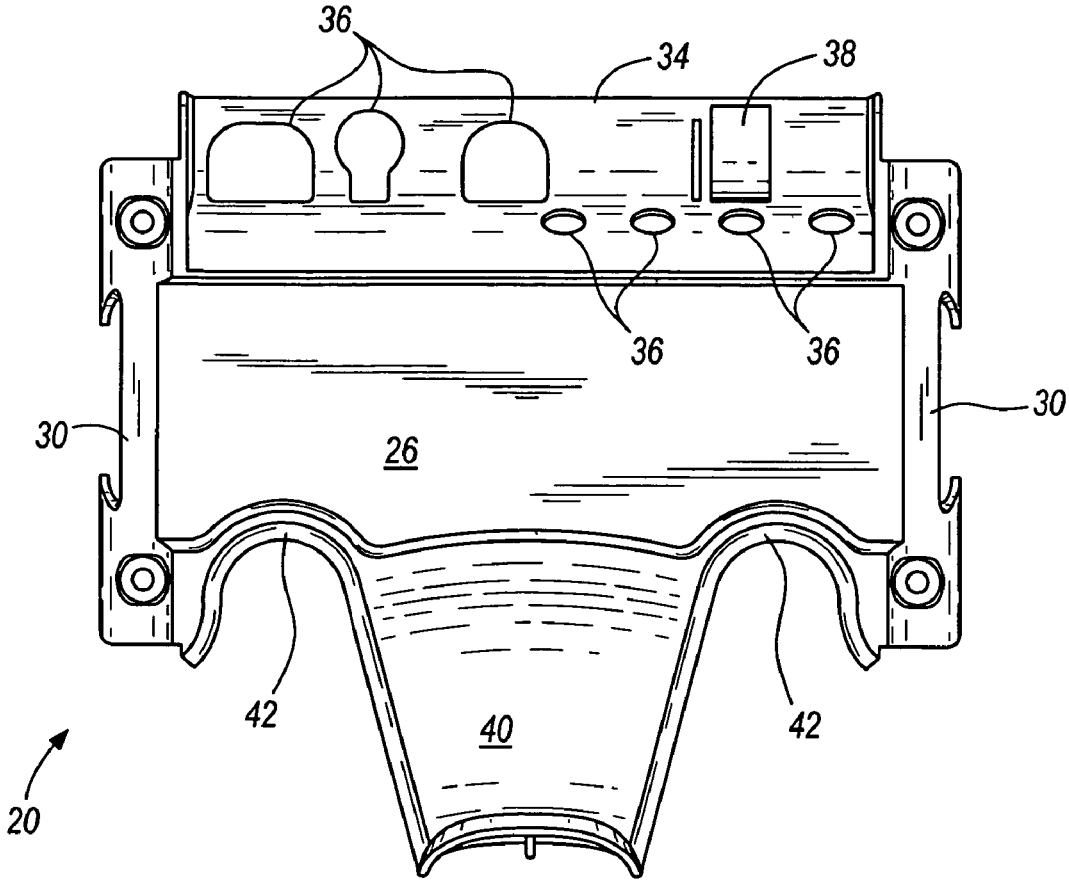
FIG. 3 is a top view of the accessory tray shown in FIG. 1.
Figure 5:
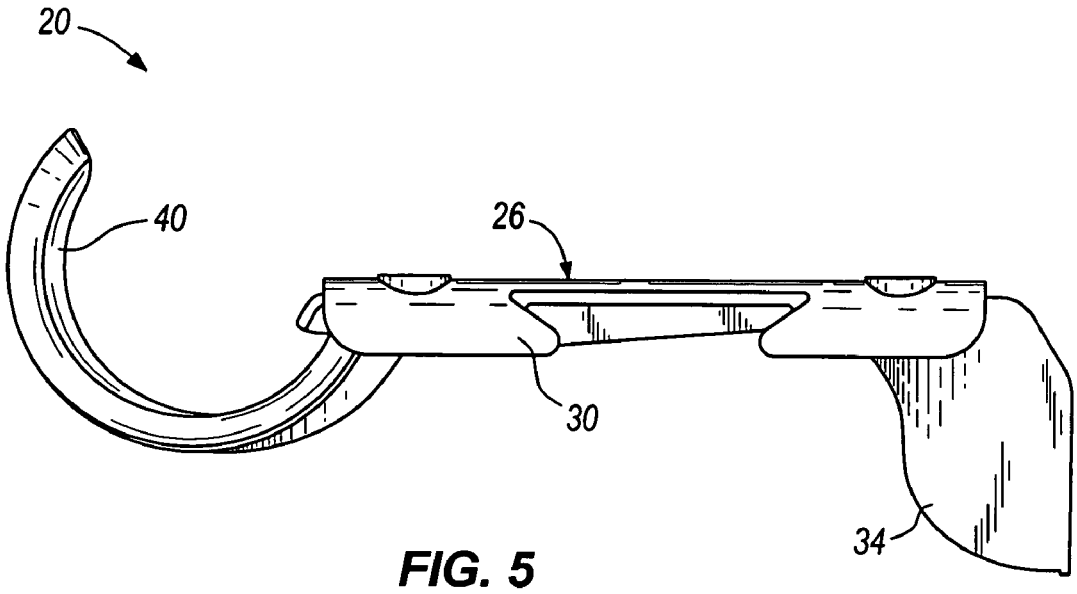
FIG. 5 is a right side view of the accessory tray shown in FIG. 1.

As best illustrated in FIGS. 2, 5, and 7, the accessory supporting portion 34 of the accessory tray 20 has a generally concave shape. The concave curved shape of the accessory supporting portion 34 of the accessory tray 20 allows the accessories 18 to engage the accessory tray 20 securely and rest substantially normal to the ground. For example, as shown in FIG. 1, a spray wand 18 is supported within the aperture 36 of the accessory tray 20 such that the wand 18 is oriented substantially normal to the ground or other support surface 27 of the pressure washer 10. Since the accessory supporting apertures 36 extend along a relatively large sector of the concave surface, accessories 18 can securely rest within the apertures 36 at an angle that is substantially normal to the ground 27 over a wide variety of angles of the accessory tray 20. Specifically, the concave shape allows the accessories 18 to rest against the accessory tray 20 at a location that has a tangent which is substantially normal to the accessory 18 as it extends through the aperture 36. Accordingly, this engagement allows the accessory 18 to be securely supported normal to the ground 27 over a wide variety of frame inclination angles. In some embodiments, accessories 18 can be supported substantially normal to the ground 27 by the concave surface over a range of inclination angles from about zero degrees to about ninety degrees (assuming the aperture extends along a large enough sector of the concave surface). This feature is advantageous because it allows a single universal accessory tray design for multiple pressure washer frame configurations.

A projection 40 also extends from the main body portion 26 of the accessory tray 20 to provide a hose hook. The hose hook 40 is positioned opposite the accessory supporting portion 34 of the accessory tray 20. The hose hook 40 allows the accessory fluid line or hose 16 to be supported and stored on the accessory tray 20. The hose hook 40 also has a concave shape to allow the fluid line 16 to be supported substantially normal to the ground 27 regardless of the frame's 12 angle of inclination. The fluid line 16 can be supported by the concave surface in a substantially normal orientation relative to the ground 27 when the frame's angle of inclination relative to the ground 27 ranges from about zero degrees to about ninety degrees.

Figure 4:
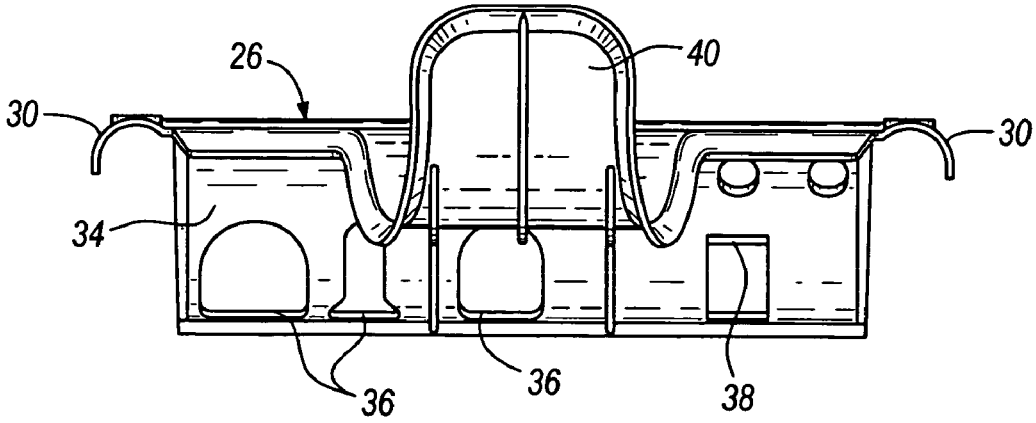
FIG. 4 is a front view of the accessory tray shown in FIG. 1.

As illustrated in FIGS. 2-5, the hose hook 40 has a saddle-like shape. In other words, the hose hook 40 has a concave shape about a first axis 41 and a convex shape about an additional axis 43 that is normal to and non-intersecting with the first axis 41 (FIG. 2). As shown in FIG. 1, the first axis 41 would extend in a direction that is generally normal to the frame member 28 of the pressure washer frame 12, while the additional axis 43 would generally extend in a direction that does not intersect the frame members 28. The hose hook 40 also tapers as it extends away from the main body portion 26. For example, as shown in FIGS. 3 and 4, the hook 40 has a first width at the main body portion 26 and a second width at the distal end of the hook 40. The first width of the hook is greater than the second width.

Recesses 42 are positioned on either side of the hose hook 40 and extend into the main body portion 26 of the accessory tray 20. These recesses 42 prevent the main body portion 26 from interfering with the orientation of the fluid line 16 when a large quantity of fluid line 16 is supported by the hook 40 and/or when the accessory tray 20 is positioned at a relatively low angle of inclination relative to the ground 27.

A second embodiment of the accessory tray 20 is illustrated in FIGS. 8-13. As illustrated in these figures, this embodiment is constructed substantially similarly to the embodiment shown in FIGS. 1-7. The major difference between the two embodiments is that the hose hook 40 is eliminated in the second embodiment.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

We claim:

1. A pressure washer comprising:

a frame including two frame members and configured to be supported on a support surface;

a prime mover coupled to the frame;

an accessory tray coupled to the frame, the accessory tray including a main body portion extending between the two frame members, wherein the accessory tray includes an accessory supporting portion having at least one aperture for receiving an accessory of the pressure washer, and wherein the accessory supporting portion is configured to support the accessory such that the accessory is substantially normal to the support surface when the accessory supporting portion is inclined relative to the support surface at a first angle and when the accessory supporting portion is inclined relative to the support surface at a second angle different from the first angle;

wherein the accessory supporting portion has a concave surface with respect to an axis that is both parallel to the accessory supporting portion and that is located on a side of the accessory supporting portion from which the accessory of the pressure washer is received, and wherein the concave surface includes the at least one aperture.

2. The pressure washer of claim 1, wherein the accessory tray further includes a flexible cantilevered member configured to retain a second accessory against the accessory supporting portion of the accessory tray.

3. The pressure washer of claim 1, wherein the at least one aperture is configured to receive at least one of a pressure washer spray gun and a nozzle for the spray gun.

4. A pressure washer comprising:

a frame including two frame members and configured to be supported on a support surface;

a prime mover coupled to the frame;

an accessory tray coupled to the frame, the accessory tray including a main body portion extending between the two frame members, wherein the accessory tray includes an accessory supporting portion having at least one aperture for receiving an accessory of the pressure washer, and wherein the accessory supporting portion is configured to support the accessory such that the accessory is substantially normal to the support surface when the accessory supporting portion is inclined relative to the support surface at a first angle and when the accessory supporting portion is inclined relative to the support surface at a second angle different from the first angle; and a hose hook portion extending from the main body portion, the hose hook portion having a hose hook surface that is concave about a first axis and convex about a second axis that is substantially normal to the first axis, the hose hook surface configured to support a hose in a suspended position above the support surface.

5. The pressure washer of claim 4, wherein the accessory tray includes a pair of recesses extending into the main body portion, and wherein one recess of the pair of recesses is positioned on each side of the hose hook portion.

6. A pressure washer comprising:

a frame including two frame members and configured to be supported on a support surface;

a prime mover coupled to the frame;

an accessory tray coupled to the frame, the accessory tray including a main body portion extending between the two frame members, wherein the accessory tray includes an accessory supporting portion having at least one aperture for receiving an accessory of the pressure washer, and wherein the accessory supporting portion is configured to support the accessory such that the accessory is substantially normal to the support surface when the accessory supporting portion is inclined relative to the support surface at a first angle and when the accessory supporting portion is inclined relative to the support surface at a second angle different from the first angle;

wherein the accessory tray has a first end configured to be coupled to one of the two frame members and a second end configured to be coupled to the other of the two frame members; and further including:

a hose coupled to the accessory tray; and a hose hook portion extending from the main body portion, the hose hook portion having a hose hook surface that is concave about a first axis, and the hose hook surface configured to support the hose in a suspended position above the support surface such that the hose is in a substantially normal orientation relative to the support surface when the hose hook portion is inclined relative to the support surface at a third angle and when the hose hook portion is inclined relative to the support surface at a fourth angle different from the third angle.

7. The pressure washer of claim 6, wherein the hose hook surface has a width defined as the overall extent of the hose hook surface in a direction from the first end of the accessory tray to the second end of the accessory tray, the width continuously decreases as the hose hook surface extends away from the main body portion.

8. The pressure washer of claim 6, wherein the hose hook surface is convex about a second axis, and wherein the first axis extends substantially normal to the frame members and the second axis is substantially oriented to be non-intersecting with the frame members.

9. The pressure washer of claim 6, wherein the accessory tray includes a pair of recesses extending into the main body portion, and wherein one recess of the pair of recesses is positioned on each side of the hose hook portion.

* * * * *